US006140941A

United States Patent [19]

Dwyer et al.

[11] Patent Number: 6,140,941

[45] **Date of Patent: *Oct. 31, 2000**

[54] OPEN ROAD CASHLESS TOLL COLLECTION SYSTEM AND METHOD USING TRANSPONDERS AND CAMERAS TO TRACK VEHICLES

[75] Inventors: Douglas Dwyer, Brea; Stephen J. Feitelson, Corona; Jeanne M. Perales-Herdt, Long Beach; Gary S. Gallagher, Oceanside; Roger O'Connor, Dove Canyon, all of Calif.; Thomas L. McDaniel, Crystal Bay, Nev.; Edward Broad, Fountain Valley, Calif.

[73] Assignee: Raytheon Company, Lexington, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/785,179

[22] Filed: Jan. 17, 1997

[51] Int. Cl.[7] ..... G08G 1/00

[52] U.S. Cl. ..... 340/928; 235/384; 340/937; 348/149; 701/117

[58] Field of Search ..... 340/928, 933, 340/937, 905; 235/384; 701/117; 348/148, 149

[56] References Cited

U.S. PATENT DOCUMENTS

| | | | |
|---|---|---|---|
| 5,101,200 | 3/1992 | Swett | 340/937 |
| 5,392,034 | 2/1995 | Kuwagaki | 340/937 |
| 5,509,082 | 4/1996 | Toyama et al. | 340/937 |
| 5,554,984 | 9/1996 | Shigenaga et al. | 340/937 |
| 5,568,406 | 10/1996 | Gerber | 340/937 |
| 5,640,156 | 6/1997 | Okuda et al. | 340/937 |
| 5,708,425 | 1/1998 | Dwyer et al. | 340/928 |
| 5,757,286 | 5/1998 | Jonsson et al. | 340/928 |

FOREIGN PATENT DOCUMENTS

| | | | |
|---|---|---|---|
| 0585718 | 3/1994 | European Pat. Off. | 340/928 |
| 9428516 | 12/1994 | WIPO | 340/928 |

*Primary Examiner*—Brent A. Swarthout

[57] ABSTRACT

A cashless toll collection system and method that detects vehicles using transponders for prepaid customers and cameras for casual or non-transponder equipped vehicles. The system has a plurality of roadside toll collectors, one or more toll transaction processors, and a revenue management system. Each roadside toll collector has a vehicle to roadside communications system that communicates with transponders disposed in transponder equipped vehicles and generates entry and exit transaction reports indicating the entry and exit locations and times of the transponder equipped vehicles. Each roadside toll collector has a plurality of license plate cameras that selectively provide video images of license plates of vehicles that are not equipped with a transponder. Each roadside toll collector has a vehicle detector and classification system that detects the presence of vehicles, controls the cameras to capture the video images of the license plates, and generates entry and exit transaction reports indicating the entry and exit locations and times, and the license plate images of each detected vehicle that is not equipped with a transponder. The toll transaction processor processes the transaction reports to generate tolling transactions for each vehicle. The revenue management system processes the tolling transactions to generate tolls for each vehicle and generate bills for use of the toll road.

6 Claims, 6 Drawing Sheets

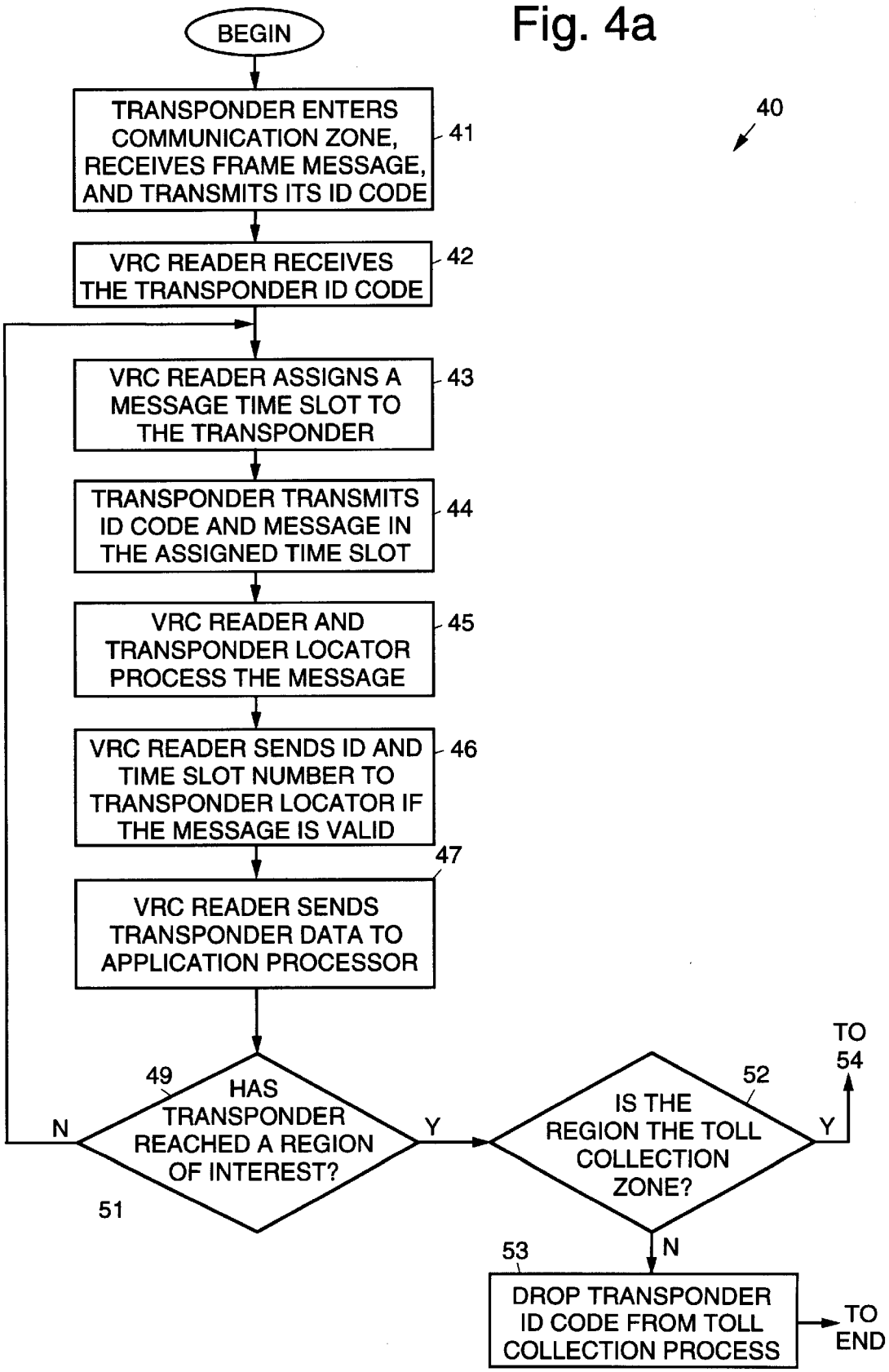
Fig. 4a
40
BEGIN
TRANSPONDER ENTERS COMMUNICATION ZONE, RECEIVES FRAME MESSAGE, AND TRANSMITS ITS ID CODE
41
VRC READER RECEIVES THE TRANSPONDER ID CODE
42
VRC READER ASSIGNS A MESSAGE TIME SLOT TO THE TRANSPONDER
43
TRANSPONDER TRANSMITS ID CODE AND MESSAGE IN THE ASSIGNED TIME SLOT
44
VRC READER AND TRANSPONDER LOCATOR PROCESS THE MESSAGE
45
VRC READER SENDS ID AND TIME SLOT NUMBER TO TRANSPONDER LOCATOR IF THE MESSAGE IS VALID
46
47
VRC READER SENDS TRANSPONDER DATA TO APPLICATION PROCESSOR
49
HAS TRANSPONDER REACHED A REGION OF INTEREST?
51
N
Y
52
IS THE REGION THE TOLL COLLECTION ZONE?
Y
TO 54
N
53
DROP TRANSPONDER ID CODE FROM TOLL COLLECTION PROCESS
TO END

OPEN ROAD CASHLESS TOLL COLLECTION SYSTEM AND METHOD USING TRANSPONDERS AND CAMERAS TO TRACK VEHICLES

BACKGROUND

The present invention relates generally to toll road revenue collection systems, and more particularly, to an open toll road cashless revenue collection system employing transponders and cameras to track vehicles.

Typically, conventional toll roads use manned or unmanned toll booths to collect tolls for using the roads. The toll booths typically use human operators, which introduces the possibility of human errors. Toll booths are lane and speed restrictive. A toll booth requires a vehicle to stay in one lane, and the vehicle operator must stop and endure the inconvenience of a cash transaction, whether by paying a human toll collector or by depositing cash in a toll collection machine.

Other conventional toll roads use lane restricted electronic toll collection systems. This type of restriction does not require vehicles to completely stop although the vehicle must usually slow down. This type of system requires the construction of barrier lanes and toll booths. The barrier lanes and toll booths add to the cost of the infrastructure of a toll road. The barriers and lane restrictions force commuters to slow down, leading to traffic congestion.

Thus, conventional system either have transponders and cash, which requires toll booths and cash handling, or they use transponders only, which reduces patronage.

Accordingly, it is an objective of the present invention to provide for an open road toll cashless collection system employing transponder and camera tracking of vehicles that eliminates the restrictions placed upon drivers by conventional systems. It is a further objective of the present invention to provide for an open road toll collection system that tracks vehicles in multiple lanes using transponders and cameras and eliminates the need for vehicles to stop or reduce speed for fee collection while allowing both transponder equipped and vehicles without transponders to use the toll road.

SUMMARY OF THE INVENTION

To meet the above and other objectives, the present invention provides for an open toll road, cashless toll collection system that provides for vehicle detection and identification using transponders for prepaid customers and cameras for casual or non-transponder equipped vehicles. The cashless toll collection system discriminates between these two types of vehicles and bills the user or owner of the vehicle accordingly. The present invention allows highly accurate detection of vehicles in multiple lanes while discriminating between transponder equipped vehicles and non-transponder equipped vehicles.

The system comprises a plurality of roadside toll collectors, one or more toll transaction processors, and a revenue management system. Each roadside toll collector comprises a vehicle to roadside communications system for communicating with transponders disposed in transponder equipped vehicles and generates entry and exit transaction reports that are indicative of the entry and exit locations and times of the transponder equipped vehicles. Each roadside toll collector has a plurality of license plate cameras that selectively provide video images of license plates of vehicles that are not equipped with a transponder. Each roadside toll collector has a vehicle detector and classification system that detects the presence of vehicles, controls the cameras to capture the video images of the license plates of vehicles, and generates entry and exit transaction reports that contain data that is indicative of the entry and exit locations and times, and the license plate images of each detected vehicle that is not equipped with a transponder. The toll transaction processor is coupled to the plurality of roadside toll collectors and processes the transaction reports to generate tolling transactions for each vehicle. The revenue management system is coupled to the toll transaction processors and processes the tolling transactions to compute tolls for each vehicle and generate bills for use of the toll road.

More specifically, each roadside toll collector has an ID reader coupled to a plurality of antennas that transmits frame messages to the transponders which decode the messages and transmit their respective transponder ID codes. The ID reader assigns a time slot in a message frame for each transponder to transmit the data stored in its memory, and reads ID codes and stored data transmitted by the transponders.

The roadside toll collector has a transponder locator that processes the ID codes from each transponder to build a track file that is indicative of the path of the transponder and vehicle. The vehicle detector and classification system include a laser-based sensor that generates two fan-beam scanning laser beams that are sensed to determine speed, height, length and profile of vehicles as they pass therethrough.

The roadside toll collector includes a processor that sends the ID codes of the transponders and the times of entry into and exit from the toll road of the transponder equipped vehicles, sends the video images of license plates of the vehicles derived from the license plate camera of the non-transponder equipped vehicles and outputs transaction reports relating to each vehicle, and sends a site ID of the roadside toll collector to the toll transaction processor. The toll transaction processor receives the transaction reports from each of the processors in the roadside toll collectors and processes them to generate tolling transactions comprising paired entry and exit times and locations for each vehicle. The revenue management system processes the tolling transactions to generate tolls for each vehicle.

The toll collection system thus comprises an over-the-air, line-of-sight two-way vehicle to roadside communication system. This system transfers data from the vehicle transponders to the VRC reader in the roadside toll collector and from the reader to the transponder. The transponder has a read-write memory in which its ID code is stored along with other relevant data. The reader continuously outputs frame messages in a predetermined radio frequency (RF) band. When the transponder moves into a communications zone of the system, it detects the transmitted reader frame messages, the transponder wakes up and attempts to decode the message. When the reader frame message is decoded correctly, the transponder is connected to the system, and transmits its transponder ID code. The reader then assigns a time slot in a message frame in which the transponder transmits its memory contents.

The transponder locator listens to radio frequency (RF) transmissions from the transponder. The transponder locator uses multiple antennas with phase array elements to determine the angle of arrival of the transmitted RF signals at each antenna. These angle of arrival measurements are combined and the geolocation of the transponder is determined. Measurements made at different times and at multiple transponder locations are processed to determine a track on the road of the path of the transponder.

The vehicle detector and classification system uses lasers and associated processing to detect the presence of a vehicle in a predefined area of the communications zone defined by the two laser beams. The vehicle detector and classification system classifies the vehicle once the vehicle has passed through the two laser beams.

The roadside toll collector determines the position of the vehicle from data provided by the vehicle detector and classification system and correlates the vehicle position with track files generated by the transponder locator. The roadside toll collector identifies transponder equipped vehicles and non-transponder equipped vehicles and processes data to accurately identify each vehicle. The transponder equipped vehicles are processed for billing using their ID codes, while license plate images of non-transponder equipped vehicles are captured and processed by the toll transaction processor and the revenue management system to generate either a bill for use of the toll road.

Thus, since vehicles can be identified and tolled with or without the use of transponders, there is no need for cash collection of casual non-transponder users. This eliminates the need for toll booths, coin machines, and cash handling. Thus, the present invention provides for a major improvement over conventional toll road toll collection systems.

Vehicles are not restricted to one lane during tolling operations, which provides for an "open road" type system. A vehicle can change lanes, be in any lane, or straddle lanes anywhere between the edges of the road. The system detects and generates a transaction report for each vehicle traveling through its toll collection area. The present invention thus provides for a multiple lane high speed detection system that discriminates between transponder equipped vehicles and non-transponder equipped vehicles and generates data from which bills are generated for use of the toll road.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 4*a* and 4*b* show a flow diagram illustrating a sequence of events encountered in using the system of FIG. 1.

DETAILED DESCRIPTION

Figure 1:
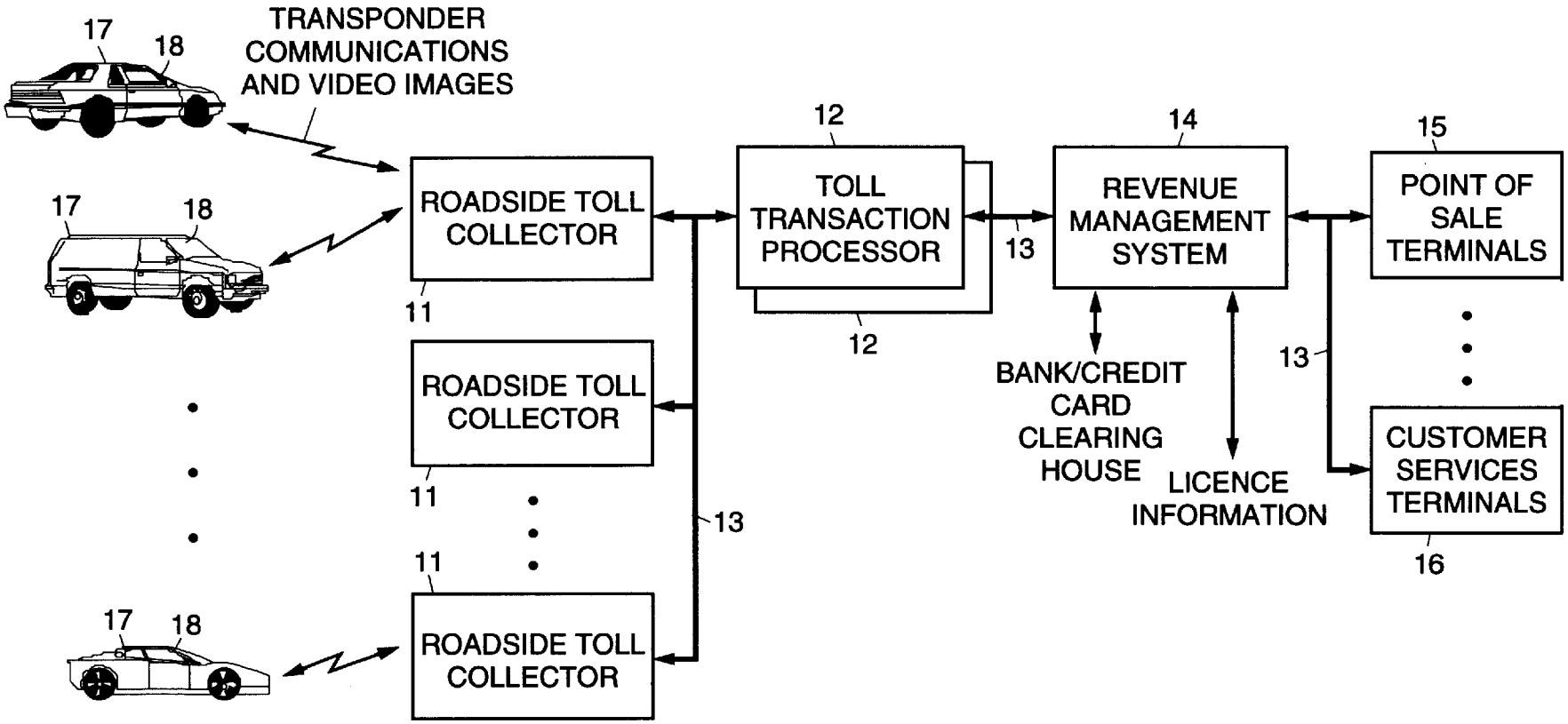
FIG. 1 illustrates a system block diagram of an open road toll collection system in accordance with the principles of the present invention.

Referring to the drawing figures, FIG. 1 illustrates an open road toll collection system 10 in accordance with the principles of the present invention. The system 10 comprises a plurality of roadside toll collectors 11, or roadside toll collection systems 11, that are coupled by way of a fiber optic network 13 to one and preferably two redundant toll transaction processors 12. The toll transaction processors 12 are coupled by way of the fiber optic network 13 to a revenue management system 14 that interfaces with computers of an appropriate motor vehicle authority to obtain license information regarding vehicles 17, and bank and credit card clearing houses to process bills and receive payments. The revenue management system 14 is coupled by way of the fiber optic network 13 to point of sale terminals 15 and customer service terminals 16.

Figure 2A:
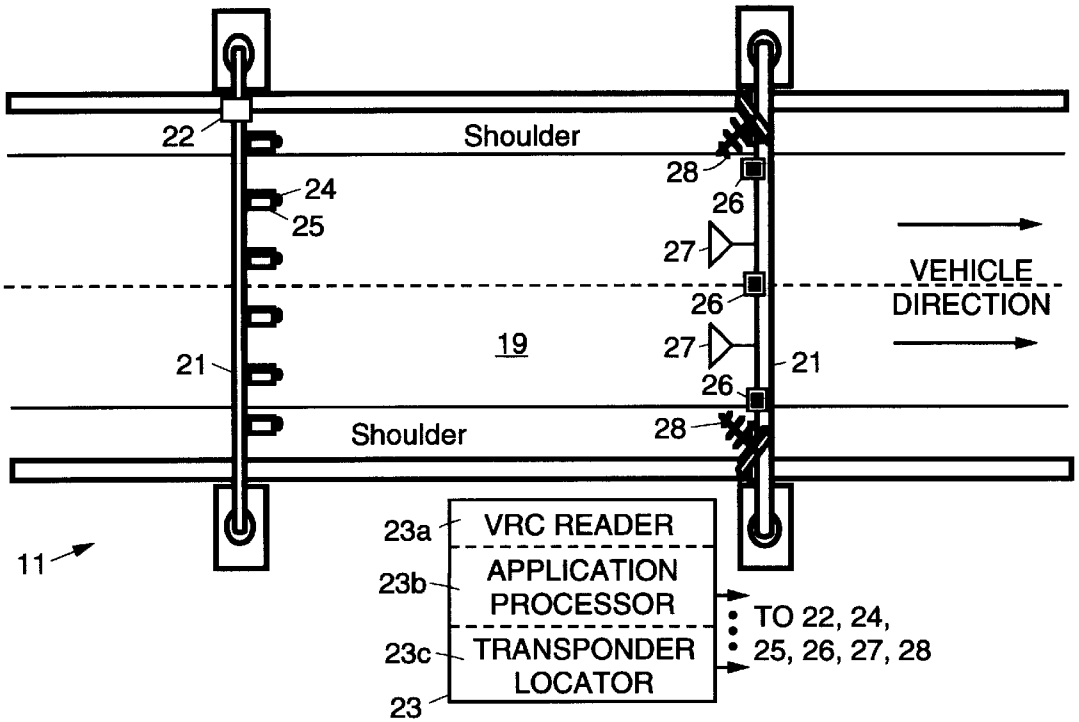
FIGS. 2*a* and 2*b* illustrate top and side views, respectively, of an embodiment of a roadside toll collector employed in the system of FIG. 1.
Figure 2B:
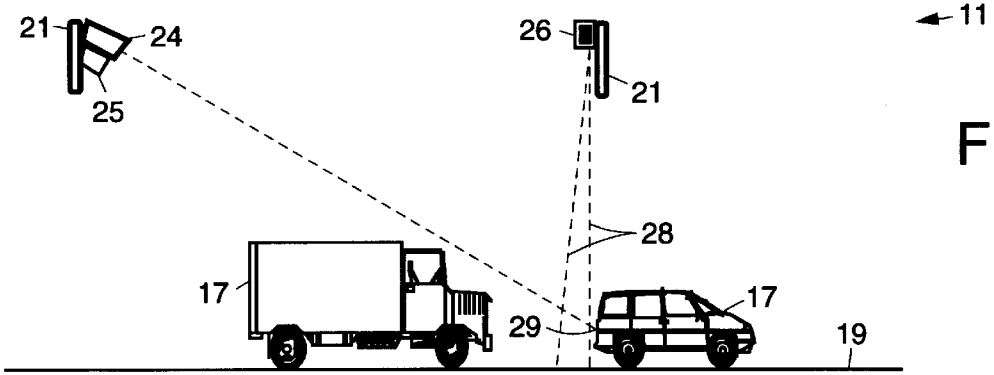

Vehicles 17 may contain windshield-mounted transponders 18 that communicate with individual roadside toll collectors 11 upon entry to and exit from a toll road 19 (FIGS. 2*a* and 2*b* ). The vehicles are detected when they enter and exit the toll road 19 which provides data indicative of the locations and times of entry into and exit from the toll road 19. The transponder 18 transmits transponder identification data to the roadside toll collectors 11 that is correlated with the vehicle detection data. The identification data, location data, and entry and exit data are processed by the roadside toll collectors 11 to generate transaction reports for each vehicle 17. The toll transaction processor 12 processes the transaction reports to generate tolling transactions for each vehicle 17. The tolling transactions are forwarded to the revenue management system 14 which generates tolls for each vehicle 17 and bills the owner of the transponders 18 for use of the toll road 19.

However, the present system 10 also permits vehicles 17 that are not equipped with a transponder 18 to also use the toll road 19. Vehicles 17 are detected to determine the time of entry into and exit from (the transaction time) the toll road 19. If no transponder 18 is detected, the system 10 uses license plate cameras 24 to capture images of the license plates 29 of the vehicles 17 (as will be described with reference to FIGS. 2*a* and 2*b*). The images of the license plates 29 are processed using optical character recognition processing to identify the owner of the vehicle. Vehicle ownership data derived from processing the images of the license plates 29 are use to bill registered owners of the vehicles 17.

Referring now to FIGS. 2*a* and 2*b*, they illustrate top and side views, respectively, of an embodiment of the roadside toll collector 11 employed in the system 10 of FIG. 1. Each roadside toll collector 11 has two gantries 21 that span the entry (and exit) lanes of the toll road 19. A plurality of license plate cameras 24 are located on the first gantry 21 that is passed by the vehicles 17 that are used to image the license plates 29 of non-transponder equipped vehicles 17. A plurality of lights 25 are also disposed on the first gantry 21 that are used to illuminate the license plates 29 in low light level conditions. A light sensor 22 may be disposed on the first gantry 21, for example, that is used to monitor the light intensity at the roadside toll collector 11 and provide feedback signals to the roadside toll collector 11 that are used to control shutter, gain, and pedestal settings of the license plate cameras 24 during changing lighting conditions that affect the quality of the imaged license plates 29.

A plurality of vehicle detector and classification (VDAC) systems 26 are disposed on the second gantry 21 along with a plurality of VRC antennas 28 that transmit and receive RF signals that communicate with the transponders 18 in transponder equipped vehicles 17. A plurality of transponder locator antennas 27 is also disposed on the second gantry 21 that are used to locate transponders 18 in the vehicles 17. Each of the vehicle detector and classification systems 26 include a laser-based sensor that generates a dual fan-beam scanning laser beam that is used to determine the speed, height, length and profile of vehicles 17 as they pass a toll collection zone.

A roadside control station 23 is disposed adjacent to the toll road 19 in the vicinity of the gantries 21. The roadside control station 23 comprises a vehicle-roadside communications (VRC) reader 23*a*, an application processor 23*b*, and a transponder locator 23*c*. The VRC reader 23*a*, application processor 23*b*, and transponder locator 23*c* are coupled to each other and transmit data and commands therebetween as required to process transactions within the roadside toll collector 11. The application processor 23*b* is also coupled to the license plate cameras 24, the lights 25, the light sensor 22, and the vehicle detector and classification systems 26. The VRC reader 23*a* is coupled to the VRC antennas 28 and is used to read each identification code (ID) transmitted from the transponders 18 and write data to the transponders 18. The transponder locator 23*c* is coupled to transponder locator antennas 27 which cooperate to locate the transponders when they pass through the toll collection zone.

FIG. 3*c* shows a more detailed block diagram of the roadside toll collector 23 depicted in FIGS. 2*a* and 2*b*. The VRC reader 23*a* includes redundant VRC processors 23*a*-1, 23*a*-2 that are coupled by way of one or more transmit/receive modules 23*a*-3 to the VRC antennas 28. The VRC processors 23*a*-1, 23*a*-2 execute a slotted aloha time division multiple access (TDMA) protocol discussed below to communicate with the transponders 18 by way of the transmit/receive modules 23*a*-3 and VRC antennas 28. The VRC reader 23*a* outputs transponder data to the application processor 23*b* which combines this data with transponder location data to provide a transponder ID and road location record referred to herein as a transaction report. Following a short burst of transmissions used to obtain data from the transponder 18, the VRC reader 23*a* commands the transponder 18 to transmit an RF burst once every few frames to allow vehicle location updates to be made until the vehicle 17 is detected by the vehicle detector and classification systems 26. When the application processor 23*b* determines, based on transponder location data, that the transponder 18 is in the toll collection zone, the VRC reader 23*c* is instructed to write entry data back to the transponder 18.

The vehicle detector and classification system 26 employed in a reduced to practice embodiment of the system 10 is manufactured by Schwartz Electro Optics. The transponder locator 23*c* employed in the system 10 is described in U.S. Pat. No. 5,227,803 assigned to the assignee of the present invention.

The transponders 18 each have a unique ID number or ID code assigned to them, which is used for identification purposes. The transponders 18 communicate with the VRC reader 23*a* using the slotted aloha TDMA communications protocol that permits communication with a large numbers of transponders 18 at the same time, and performance of the system 10 using this protocol is independent of lane position of the vehicles 17. Successful communications is possible with closely spaced vehicles 17 at speeds up to about 150 miles per hour. The slotted aloha TDMA communications protocol is described in U.S. Pat. Nos. 5,307,349 and 5,425,032, assigned to the assignee of the present invention. Each of the above-cited U.S. patents is incorporated herein by reference in their entirety.

The transponders 18 operate in the 902–928 MHz band, and at a nominal frequency of 915 MHz. The transponder messages contains 512 binary digits (bits), and a Manchester encoding technique is used for data communications. The data communications rate between the transponders 18 and the ID readers 23*d* is about 500 kilobits per second.

The transponders 18 have a factory-programmed read-only data field consisting of 32 public bits and 32 private bits. This read-only data storage is designed so that it permanently stores the ID code or serial number code in the transponder 18. However, only the 32-bit public ID can be read out of the transponder 18. The transponders 18 also have agency re-programmable data fields that may be used to store agency and vehicle classification information. The transponders 18 have a scratch pad memory that permit various communications functions. The main function of the scratch pad memory is to store toll road entry data to the exit for toll amount determination and transaction completion.

Figure 2C:
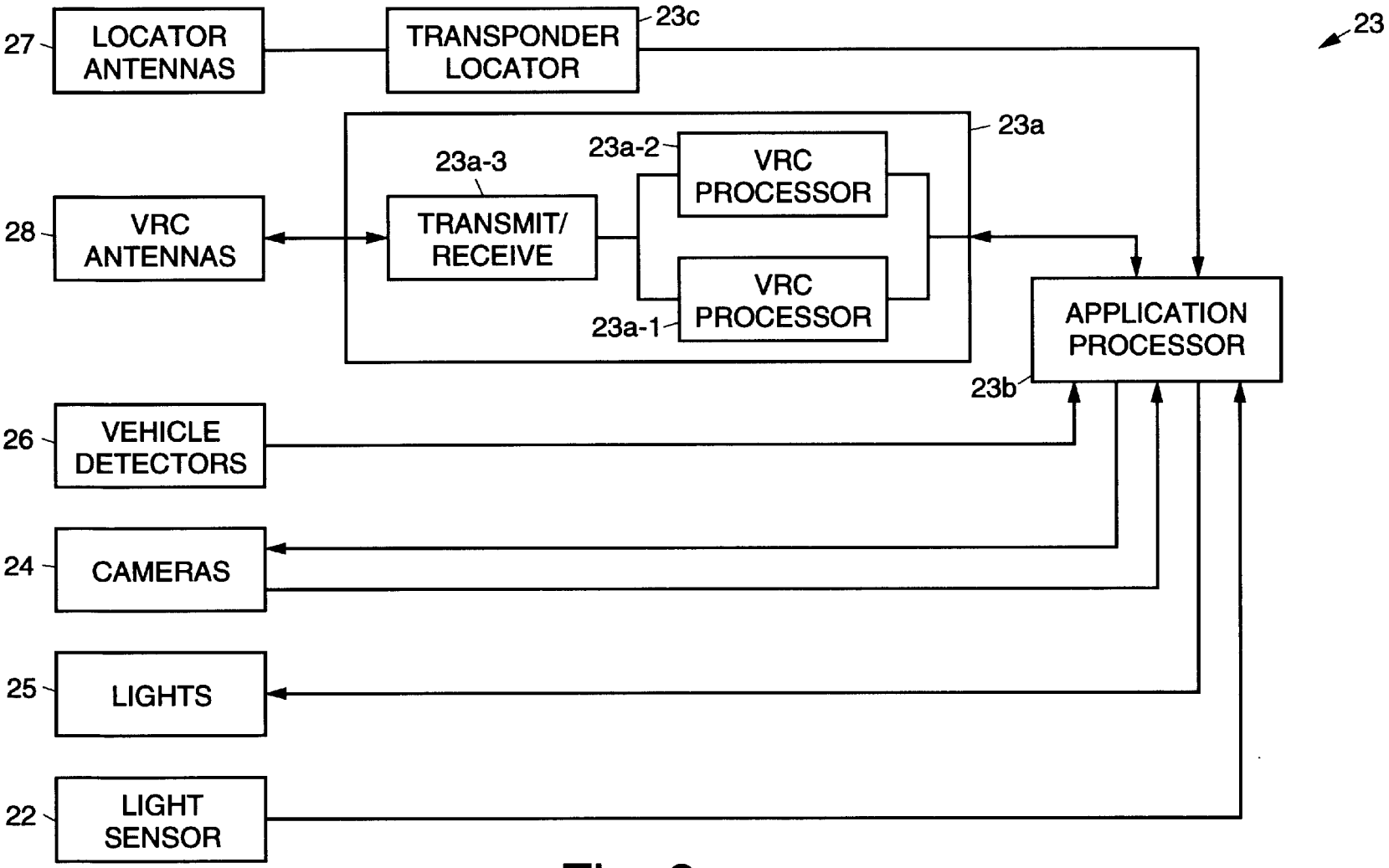
FIG. 2*c* is a more detailed block diagram of the roadside toll collector.
Figure 3:
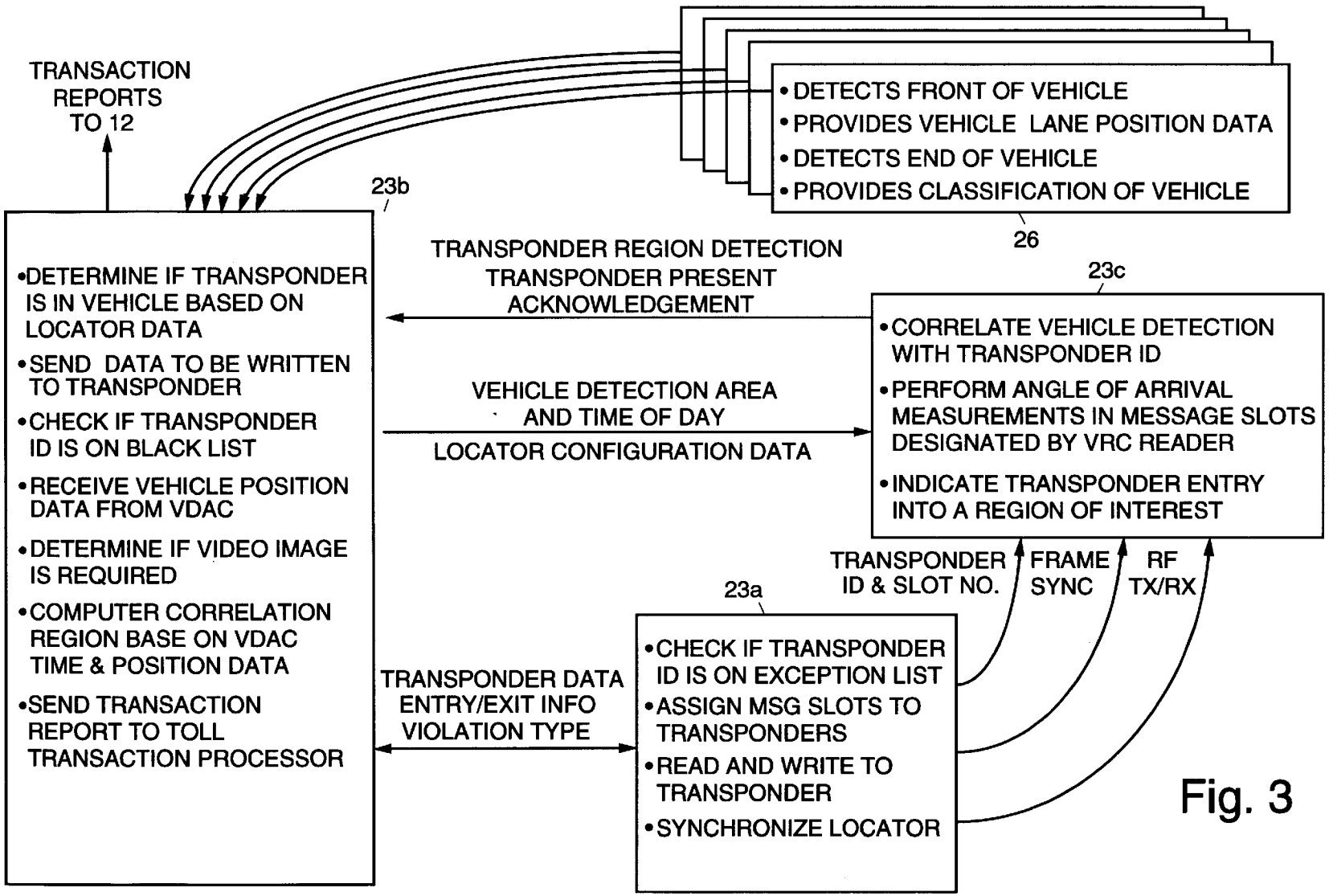
FIG. 3 illustrates a block diagram showing data flow in the roadside toll collector of FIG. 2.

Referring now to FIG. 3, it illustrates a block diagram showing data flow in the roadside toll collector 11 of FIG. 2. The operations illustrated in FIG. 3 are self explanatory. The roadside toll collector 11 correlates data derived from three independent processes that operate within the roadside toll collector 11 to identify each vehicle 17. Data derived from the transponders 18 are supplied to the VRC reader 23*a*. When a transponder 18 enters the communication zone, the identification (ID) number of the transponder 18 is read. The transponder 18 is then tracked and track data is accumulated by the transponder locator 23*c*. Vehicle position data is sent from the vehicle detector and classification system 26 to the application processor 23*b* for processing.

Figure 4B:
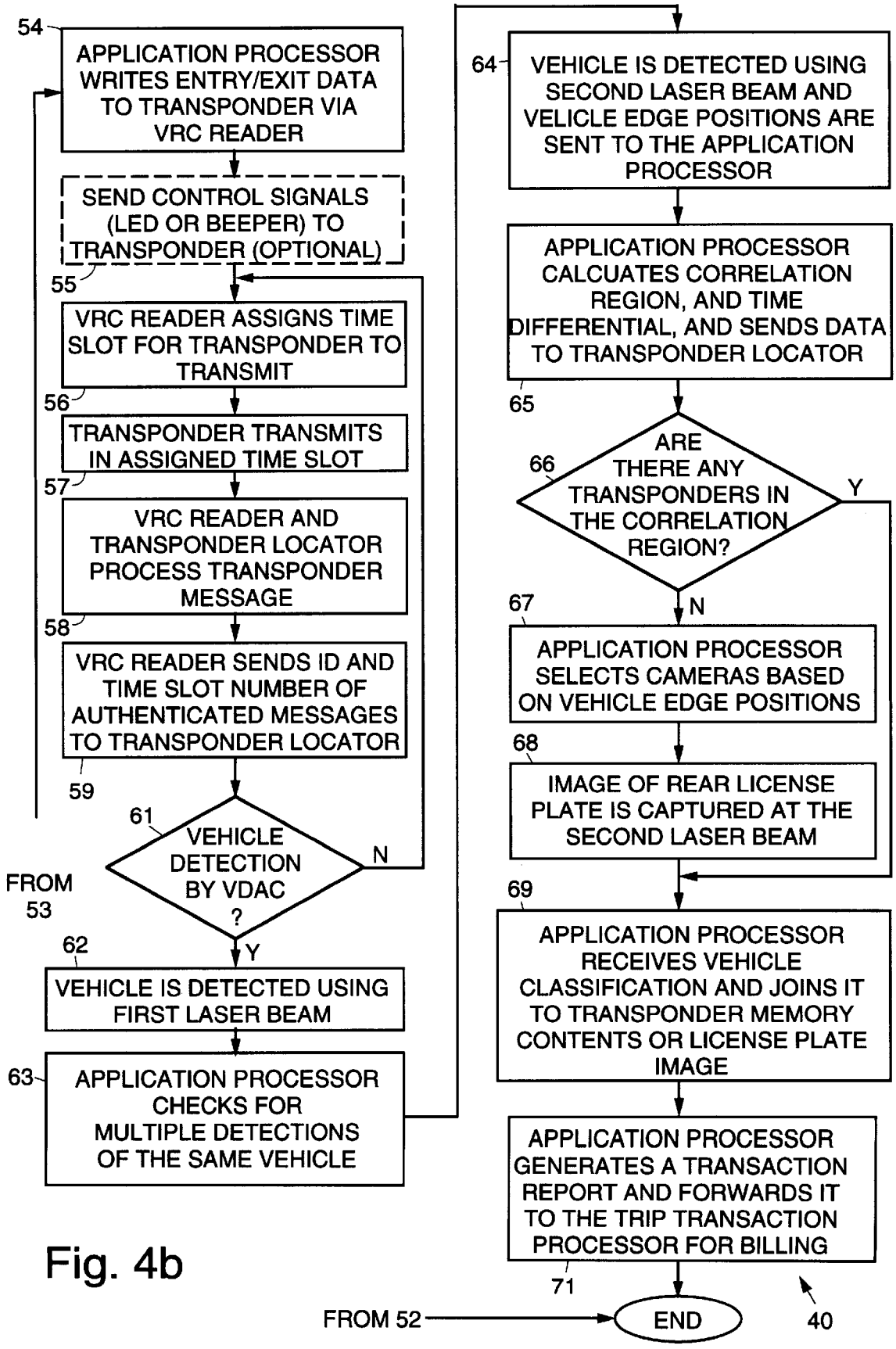

The various operations performed by the respective components of the roadside toll collector 11 and the overall operation of the system 10 will be better understood with reference to FIGS. 4*a* and 4*b*. FIGS. 4*a* and 4*b* show a flow diagram illustrating a chronological sequence of events 40 that occurs when vehicles 17 interact with the system 10 of FIG. 1.

The first steps in the method 40 involve reading and authenticating the transponder 18. The VRC reader 23*a* continuously transmits reader frame messages in a predetermined radio frequency (RF) band by way of the VRC antennas 28 within a limited distance communications zone (i.e., the vicinity of the roadside toll collector 11). As a transponder-equipped vehicle 17 approaches the communications zone, the transponder 18 in the vehicle 17 detects the transmitted RF energy and "wakes up". The transponder 18 then attempts to decode the reader frame messages. When one of the reader frame messages is decoded correctly, the transponder 18 transmits 41 its identification code (ID) to the VRC reader 23*a*.

The VRC reader 23*a* then receives 42 the ID from the transponder 18, and assigns 43 a time slot in a frame to the transponder 18. The transponder 18 then transmits 44 its memory contents (ID code and other stored data) in that time slot. The VRC reader 23*a* and the transponder locator 23*c* simultaneously receive 45 the memory contents transmitted by the transponder 18.

If the transmitted message is correctly decoded by the VRC reader 23*a* indicating that a valid message was received, the VRC reader 23*a* sends 46 the transponder ID and time slot number to the transponder locator 23*c*. The VRC reader 23*a* also sends 47 the memory contents transmitted by the transponder 18 to the application processor 23*b*.

Based upon data from the transponder locator 23*c*, it is determined 49 if the transponder 18 has reached a region of interest. Typical regions of interest include the toll region, and an out-of-bounds region indicating transponder is on another roadway. Then steps 43–49 are repeated until it is determined 52 that the region of interest is the toll collection zone. Thus, the VRC reader 23*a* assigns 43 the transponder 18 another time slot in which to retransmit 44 its memory contents. The VRC reader 23*a* and the transponder locator

23*c* process 45 the retransmitted memory contents. This process is repeated so that the transponder locator 23*c* can build the track file for the transponder 18. These steps are repeated until the vehicle 17 enters 49 the predefined region of interest or is no longer in the toll collection zone. If the vehicle 17 leaves the toll road 19, eventually the ID number of the transponder 18 becomes inactive and is purged 53. If the transponder 18 enters or exits 49 a predefined region of interest, the transponder locator 23*c* sends a message to alert the VRC reader 23*a* of this event.

If the region entered by the transponder 18 is a toll collection region, the VRC reader 23*a* processes the transponder equipped vehicle 17 for toll collection. Other predefined regions may have different processes depending upon the configuration of the site. Typically, transponders 18 entering out-of-bounds regions are purged from further processing. The application processor 23*b* writes 54 an entry or exit message to the transponder 18 via the VRC reader 23*a*. This process sends data from the application processor 23*b* via the VRC reader 23*a* and VRC antennas 28 to the transponder 18. The transponder 18 receives the data, verifies its authenticity, then writes the received data into its memory.

The application processor 23*b* optionally activates 55 audio or visual indicators on the transponder 18 via the VRC reader 23*a*. The VRC reader 23*a* continues to assign 56 transmit time slots to the transponders 18 of all transponder equipped vehicles 17 that are tracked. The transponder 18 transmits 57 the message, and the VRC reader 23*a* authenticates and acknowledges the message. The VRC reader 23*a* sends 58 the ID, frame, and time slot data to the transponder locator 23*c*. The application processor 23*b* sends the ID number and time slot number of the authenticated messages to the transponder locator 23*c* which tracks 59 the location of the transponder 18 by ID number. Steps 56–59 are repeated 61 until there is a vehicle 17 detected by the vehicle detector and classification system 26.

As a vehicle 17 passes through the toll collection zone, one or more vehicle detector and classification system 26 (depending upon where the vehicle 17 is located) detects 62 the vehicle 17 and sends one or more vehicle detection messages to the application processor 23*b*. The application processor 23*b* checks 63 to see if there are detection messages from more than one vehicle detector and classification system 26, and joins the messages to produce a composite detection.

The vehicle 17 is detected 64 by the vehicle detector and classification system 26, which sends a vehicle detection update message to the application processor 23*b* when the vehicle 17 passes the second laser beam provided by the vehicle detector and classification system 26. In the vehicle detection update message, the vehicle detector and classification system 26 provides the position of each side of a vehicle 17. In cases where the vehicle 17 is detected by two vehicle detector and classification systems 26, the left and right edges of the vehicle 17 are calculated from the respective sensors of the vehicle detector and classification system 26. The application processor 23*b* determines if two simultaneous detections or detection updates are associated with one or two vehicles 17.

The application processor 23*b* calculates 65 the position of the vehicle 17 based upon the input data from the vehicle detector and classification system 26. The application processor 23*b* calculates an area occupied by the vehicle 17 (correlation region). The application processor 23*b* then sends the correlation region with a time differential to the transponder locator 23*c*. The correlation region and the time differential provide "an area in time" for the transponder locator 23*c*.

The transponder locator 23*c* searches its track files to determine 66 if any transponders 18 were in the correlation region at the time provided by the application processor 23*b*. If one or more transponders 18 were in the correlation region, the transponder locator 23*c* sends the transponder ID(s) to the application processor 23*b*. The application processor 23*b* will not take any video images for that vehicle 17.

If there is no correlation between the data from the vehicle detector and classification system 26 and the transponder locator 23*c* tracking data, the application processor 23*b* calculates the coordinates of the rear of the vehicle 17, and appropriate cameras 24 are selected 67 to image the vehicle license plate 29. An image of the rear license plate 29 of the vehicle 17 is captured 68 when the vehicle detector and classification system 26 sends a trigger message to the application processor 23*b* (as the rear of the vehicle 17 passes the second laser beam).

After the vehicle 17 has passed both laser beams, the vehicle detector and classification system 26 sends a classification report message to the application processor 23*b*. If a transponder 18 has been correlated to the messages from the vehicle detector and classification system 26, its data is coupled to the vehicle detection data. If image(s) were captured, the vehicle detection and classification data is coupled to the image.

A vehicle transaction report is then generated 71 for the vehicle 17. This report is sent from the application processor 23*b* to the toll transaction processors 12. Entry and exit data can then be matched up in the toll transaction, processors 12. If necessary, license plate images are sent from the application processor 23*b* to the toll transaction processors 12 that correspond to the vehicle 17 and the transaction report.

Thus, the present invention provides for a system 10 that implements a closed toll road 19 using an all-electronic, non-stop "invisible gate" approach to identify vehicles 17 entering and exiting from the toll road 19. Vehicles 17 are identified using in-vehicle transponders 18 with read/write capability, and that communicate via radio frequencies. Vehicle detection and classification is achieved using lasers and sensors, and cameras 24 are used to record high-resolution digital images of the license plates 29 of vehicles 17 that have no transponders 18.

Dual toll transaction processors 12 use computer and image processing technology to match the toll road 19 exit and entry transactions. This is done with transponder data or by identifying license plate numbers derived from the video images, to match entry and exit images for each vehicle 17 not having a transponder 18. The toll transactions and required video images are transmitted to the central revenue management system 14 for processing. The revenue management system 14 receives tolling transactions (paired entries and exits and exceptions) from the toll transaction processors 12 and computes the appropriate tolls depending on distance traveled, time of day, account type, vehicle classification and other pertinent variables.

The roadside toll collectors 11 are installed entirely above the road surface and thus do not require cuts or component installation in the pavement. This leads to higher reliability, easier maintenance, less interference with traffic during preventive and emergency maintenance, and longer pavement life.

The slotted aloha TDMA communications protocol permits communication with multiple transponders 18 simultaneously on one frequency, which provides very efficient use of the assigned frequency band, and only one narrow frequency band is required for communications with transponders 18. This spectral efficiency minimizes interference from other sources, and low transmission power and low transmitter duty cycle increase RF safety with respect to personnel exposures to 915 MHz frequencies.

The roadside toll collectors 11 provide an audit trail count of all passing vehicles 17, a classification verification for all vehicles 17, and a digitized video image of non-transponder equipped vehicles 17. The vehicle detection and classification system 26 uses laser-based sensors mounted over the road 19 that provide the audit trail count and vehicle classification. The dual fan-beam scanning laser having a calibrated field of view is used to determine the speed, height, length and profile of vehicles 17 as they pass the toll point. This information provides vehicle count, vehicle separation, detection of trailers and attached vehicles 17, and a measurement of the size of individual vehicles 17 and vehicle components.

The toll transaction processor 12 provides traffic monitoring and transaction processing functions. The traffic monitoring is a near real-time process carried out in the toll transaction processor 12 that computes the average speed for each completed transponder exit transaction. Transaction processing includes determination of road usage information required to compute the customer toll charge. This information includes transponder 18 or license number, entry and exit points, time of day, date, for example. The exit message sent to the toll transaction processor 12 is a composite of the entry data read from the transponder 18, and the exit information.

Processing at the toll transaction processor 12 of the digitized video images obtained from occasional customer or non-compliant transactions includes several steps. A pattern matching system is used in the toll transaction processor 12 to isolate the image of the license plate 29 within a full frame or frames of video data. Once the image of the license plate 29 is isolated, it is processed by optical character recognition (OCR) software to determine the actual license plate number. Employing multiple processing algorithms, fused into a best-fit result, the OCR software returns the license plate number, along with confidence ratings on each character read. If this was a video image captured upon entry, it is stored temporarily, awaiting match-up with the corresponding exit image captured when the vehicle 17 leaves the toll road 19.

When the vehicle 17 exits the toll road 19, and the video image is forwarded to the toll transaction processor 12, the license number is determined in the same manner as at entry, and then the license number is compared against the temporarily stored entry license numbers to locate the matching entry. Assuming a match is found, the paired image data is then forwarded to the revenue management system 14 for toll determination and billing.

For cases where a match is not found, or a low-confidence match is obtained due to unreadable characters on the license plate 29 (due to dirt or objects blocking the plate 29), the pattern matching system in the toll transaction processor 12 is used to compare the exit license plate image with candidate entry license plate images to produce a high-confidence video image entry/exit pair based on video correlation matching of the two license plate images. The confirmed pair is then forwarded to the revenue management system 14 for manual evaluation. Unmatched cases are forwarded to the revenue management system 14 after a predetermined time period and are manually evaluated.

Thus, the following steps are used in toll road entry transactions for transponder equipped vehicles 17. The memory contents of the transponder 18 is read and authenticated. The measured classification determined by the vehicle detection and classification system 26 is sent to the application processor 23*b* for processing. The measured classification is then compared with the classification stored in the transponder 18. An entry message is then written into the scratch pad memory of the transponder 18. A transaction report is then sent to the toll transaction processor 12.

At exits, the following steps are carried out for transponder equipped vehicles 17. The memory contents of the transponder 18 is read and authenticated. The measured classification determined by the vehicle detection and classification system 26 is sent to the application processor 23*b* for processing. An exit message is then written into the scratch pad memory of the transponder 18. An transaction report is then sent to the toll transaction processor 12. Appropriate transaction status messages are communicated to the vehicle 17 via the transponder 18.

The logic for the above-delineated steps is as follows. (a) If the transponder 18 is on the exception list, video images of the license plate of the vehicle 17 are captured. (b) If there is a class mismatch on entry to the toll road, a violation report is generated that is sent to other roadside toll collectors 11. (c) If a class violator is detected at an exit as reported in (b), video images of the license plate of the vehicle 17 are captured.

If vehicles 17 are not equipped with valid transponders 18 then processing is done using the vehicle detection and classification system 26 and license plate image capture systems. Transponder transactions for customers with vehicle classification inconsistencies or for exceptions list transponders 18 are supplemented by vehicle image data (i.e. converted into image transactions).

The steps involved in the processing of a non-transponder equipped or no-balance, lost, stolen or misclassified vehicle 17 are presented below. The presence of the vehicle 17 is detected, and its speed and classification is determined. Any transponder data that may be present is then read. Classification data for the vehicle 17 is sent to the processor 23*b*. Video images of the license plate 29 of the vehicle 17 are captured. The images and available transponder data are sent to the toll transaction processor 12 for determination of the appropriate toll.

Thus, an open road cashless toll collection system has been disclosed that tracks vehicles in multiple lanes using transponders and cameras and eliminates the need for vehicles to stop or reduce speed for fee collection. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A method of determining tolls for use of a toll road for vehicles containing transponders and for vehicles that do not contain transponders, said method comprising the steps of:

detecting vehicles on the toll road and generating area data indicative of the particular position of a vehicle on the roadway and detection time of each vehicle at such position;

processing transponder ID codes for a transponder-equipped vehicle;

detecting the location of transponders associated with vehicles on the toll road and generating location data indicative of the location of the transponders;

determining whether a vehicle is a transponder-equipped vehicle by examining whether a correlation exists between the area data and the location data;

generating transaction reports for the transponder-equipped vehicles comprising information about a vehicle's travel on the toll road;

generating video images of license plates of vehicles that do not contain a transponder;

processing the video images of the license plates to determine the license plate numbers of the vehicles that do not contain a transponder;

generating transaction reports for the vehicles tat do not contain transponders comprising information about a vehicle's travel on the toll road; and processing the respective transaction reports associated with each vehicle to determine tolls for the use of the toll road, and when a vehicle does not contain a transponder, performing the steps of:

isolating an image of the license plate of the vehicle derive from data obtained at the first individual location within one or more frames of video data using a pattern matching system;

processing the isolated image of the license plate obtained at the first individual location using optical character recognition software to determine the actual plate number;

isolating an image of the license plate of the vehicle derived from data obtained at the second different individual location within one or more flames of video data using the pattern matching system;

processing the isolated image of the license plate obtained at the second different individual location using optical character recognition software to determine the actual plate number; and comparing the two actual license plate numbers to confirm that they match;

processing nonvideo data contained in the transaction reports to determine the tolls for use of the toll road.

2. The method of claim 1 wherein the steps of processing the video images of the license plates each comprise the step of:

processing the video images of the license plates using an optical character recognition program to determine the license plate numbers.

3. The method of claim 1 wherein the steps of detecting vehicles further comprises the step of detecting the vehicles using a plurality of laser beams.

4. The method of claim 3 wherein the step of detecting vehicles comprises processing signals derived from the plurality of laser beams to determine the speed, height, length and profile of the vehicles.

5. The method of claim 1 wherein the steps of processing transponder ID codes for transponder-equipped vehicles each comprise the step of:

communicating with the transponders using a slotted aloha time division multiple access communications protocol.

6. The method of claim 1, the step of comparing the two actual license plate numbers further comprising the steps of:

in cases where a match is not found, or a low confidence match is obtained;

comparing the image of the license plate obtained at the second different individual location with candidate images of license plates that potentially match using video correlation matching of the license plate images; and manually evaluating the correlation matched license plate images to determine an actual match.

* * * * *